US007859357B2

(12) United States Patent
Ishihara

(10) Patent No.: US 7,859,357 B2
(45) Date of Patent: Dec. 28, 2010

(54) NON-RECIPROCAL CIRCUIT DEVICE

(75) Inventor: Jinsei Ishihara, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/727,290

(22) Filed: Mar. 19, 2010

(65) Prior Publication Data

US 2010/0182095 A1 Jul. 22, 2010

Related U.S. Application Data

(63) Continuation of application No. PCT/JP2008/065007, filed on Aug. 22, 2008.

(30) Foreign Application Priority Data

Sep. 28, 2007 (JP) ..... 2007-255076

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,504,445 B1 * 1/2003 Kocharyan ..... 333/1.1
2002/0033742 A1 3/2002 Makino et al.
2006/0077017 A1 * 4/2006 Kinoshita et al. ..... 333/1.1

FOREIGN PATENT DOCUMENTS

| | | |
|---|---|---|
| JP | 2002-198707 A | 7/2002 |
| JP | 2006-135493 A | 5/2006 |
| WO | 2006/011383 A1 | 2/2006 |

OTHER PUBLICATIONS

Official Communication issued in International Patent Application No. PCT/JP2008/065007, mailed on Nov. 25, 2008.

* cited by examiner

*Primary Examiner*—Stephen E Jones
(74) *Attorney, Agent, or Firm*—Keating & Bennett, LLP

(57) ABSTRACT

A non-reciprocal circuit device includes a yoke that is small-sized, has a simple structure, has sufficient adhesive strength, and can achieve favorable performance characteristics. The non-reciprocal circuit device includes a planar yoke, permanent magnets, a ferrite to which a DC magnetic field is applied by the permanent magnets, and first and second center electrodes located on the ferrite. The planar yoke is located on the upper surface of the ferrite-magnet assembly through an adhesive layer. On the rear surface of the yoke, protrusions are arranged in a lattice manner, and the protrusions increase the adhesive strength and facilitate the flow of a high-frequency field generated from the second center electrode.

6 Claims, 6 Drawing Sheets

NON-RECIPROCAL CIRCUIT DEVICE

BACKGROUND OF THE INVENTION

1. Field of the Invention

The present invention relates to non-reciprocal circuit devices, and, more particularly, to non-reciprocal circuit devices, such as isolators or circulators, for use in the microwave band.

2. Description of the Related Art

In general, non-reciprocal circuit devices, such as isolators or circulators, have a characteristic of transmitting a signal only in a given direction but not in the opposite direction. By utilizing this characteristic, for example, isolators are used in transmitting circuits of mobile communication devices, such as automobile phones and cellular phones.

In order to protect a ferrite in which a center electrode is provided and an assembly of permanent magnets that apply a DC magnetic field to the ferrite, a non-reciprocal circuit device of the type described above has a structure in which the periphery of the assembly is surrounded by an annular yoke (see, for example, International Publication No. 2006/011383) or a box-shaped yoke (see, for example, Japanese Unexamined Patent Application Publication No. 2002-198707).

However, in a known non-reciprocal circuit device, an annular yoke or a box-shaped yoke obtained by forming soft iron or the like into an annular shape is used as a magnetic-shielding component. Thus, the soft iron formation processing or assembling takes time, resulting in a high cost. Moreover, since the yoke is present in the periphery of the ferrite or the permanent magnets, the size of the outer shape of the non-reciprocal circuit device itself increases. Or, when the increase in the size of the outer shape is avoided, the size of the ferrite or the permanent magnets decreases, which causes a problem of deteriorating electrical characteristics. This is caused by the fact that the reduced-size ferrite causes the size of the center electrode to be reduced, which reduces an inductance value or a Q value.

SUMMARY OF THE INVENTION

Thus, the present inventors have examined using a planar yoke in place of a conventional yoke. The planar yoke is adhered to the upper surface of a ferrite-magnet assembly through an adhesive layer. In such a case, when the planar yoke merely has a planar shape, the adhesive strength is not sufficient, and a high-frequency field generated in the ferrite is confined to the vicinity of the ferrite, which makes it difficult to obtain favorable performance characteristics.

Accordingly, preferred embodiments of the present invention provide a non-reciprocal circuit device in which a yoke is small-sized, has a simple structure, has sufficient adhesive strength, and can achieve favorable performance characteristics.

A non-reciprocal circuit device according to a preferred embodiment of the present invention includes permanent magnets, a ferrite to which a DC magnetic field is applied by the permanent magnets, a first center electrode and a second center electrode including a conductor film and arranged on the ferrite so as to intersect each other while being electrically insulated from each other, and a planar yoke, wherein the ferrite and the permanent magnets define a ferrite-magnet assembly that is sandwiched by the permanent magnets from both sides in parallel or substantially in parallel with a surface on which the first and second center electrodes are provided, the planar yoke being adhered to the upper surface of the ferrite-magnet assembly through an adhesive layer, and the adhered surface being provided with an uneven portion that increases adhesive strength and facilitates flow of a high-frequency field generated from the second center electrode.

The planar yoke according to a preferred embodiment of the present invention preferably is located right above the ferrite-magnet assembly through the adhesive layer, and the planar yoke has a simple structure. Thus, the non-reciprocal circuit device is easy to produce and handle as compared with the conventional yoke formed of soft iron.

The adhered surface of the planar yoke according to a preferred embodiment of the present invention is preferably provided with an uneven portion. When the uneven portion fits to the adhered surface, the uneven portion increases the adhesive strength and facilitates the flow of a high-frequency field generated from the second into the outer layer of the planar yoke or the adhesive layer. Thus, performance characteristics in a high frequency band increase.

According to a preferred embodiment of the present invention, the planar yoke is located right above the ferrite-magnet assembly through the adhesive layer. Thus, the structure of the yoke is simplified. Furthermore, since the adhered surface of the planar yoke is provided with an uneven portion, the adhesive strength is sufficient and the performance characteristics in a high frequency band become favorable.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, examples of a non-reciprocal circuit device according to various preferred embodiments of the present invention will be described with reference to the attached drawings.

Figure 1:
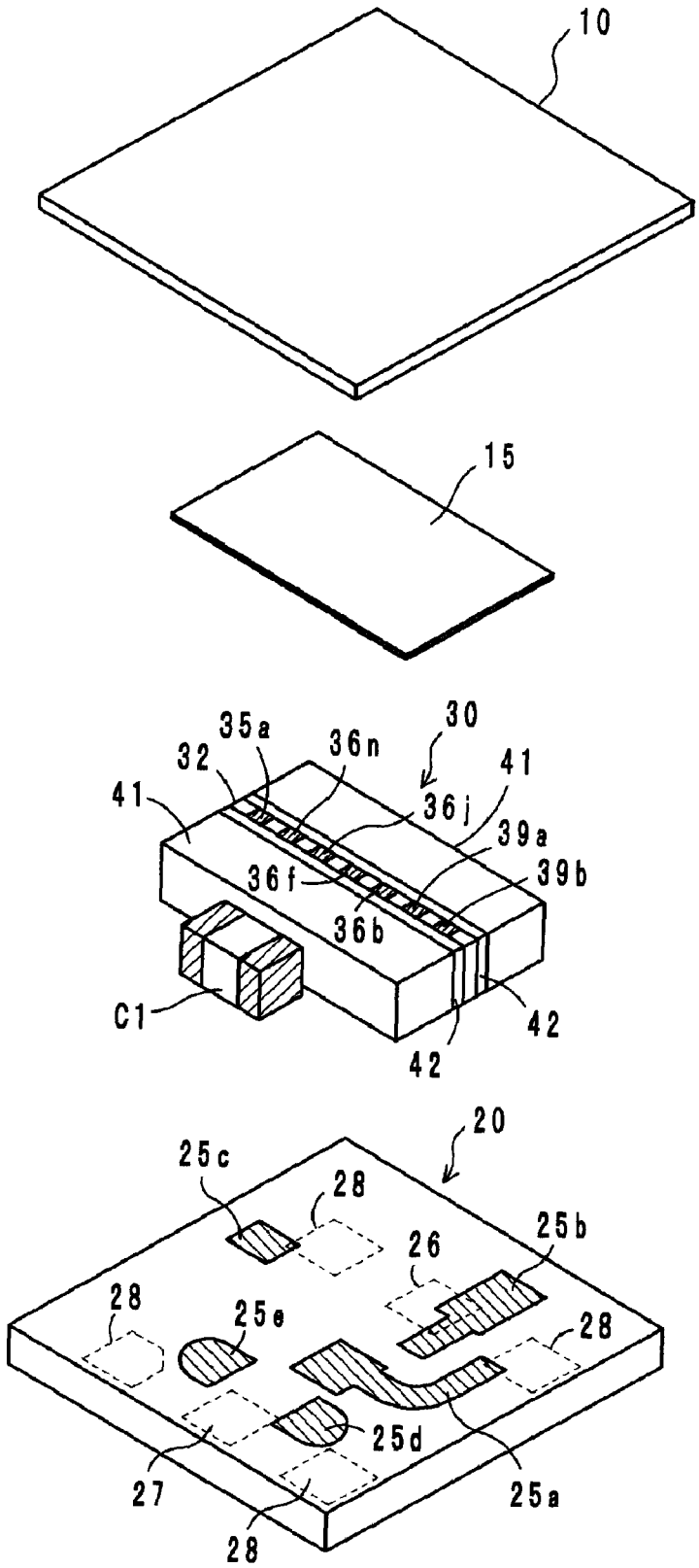
FIG. 1 is an exploded perspective view of an example of a non-reciprocal circuit device (two-port isolator) according to a preferred embodiment of the present invention.

FIG. 1 illustrates an exploded perspective view of a two-port isolator of one example of the non-reciprocal circuit device according to a preferred embodiment of the present invention. The two-port isolator preferably is a lumped constant type isolator, and is roughly constituted by a planar yoke 10, a circuit board 20, and a ferrite-magnet assembly including a ferrite 32 and permanent magnets 41. In FIG. 1, the diagonally shaded portion is a conductor.

Figure 2:
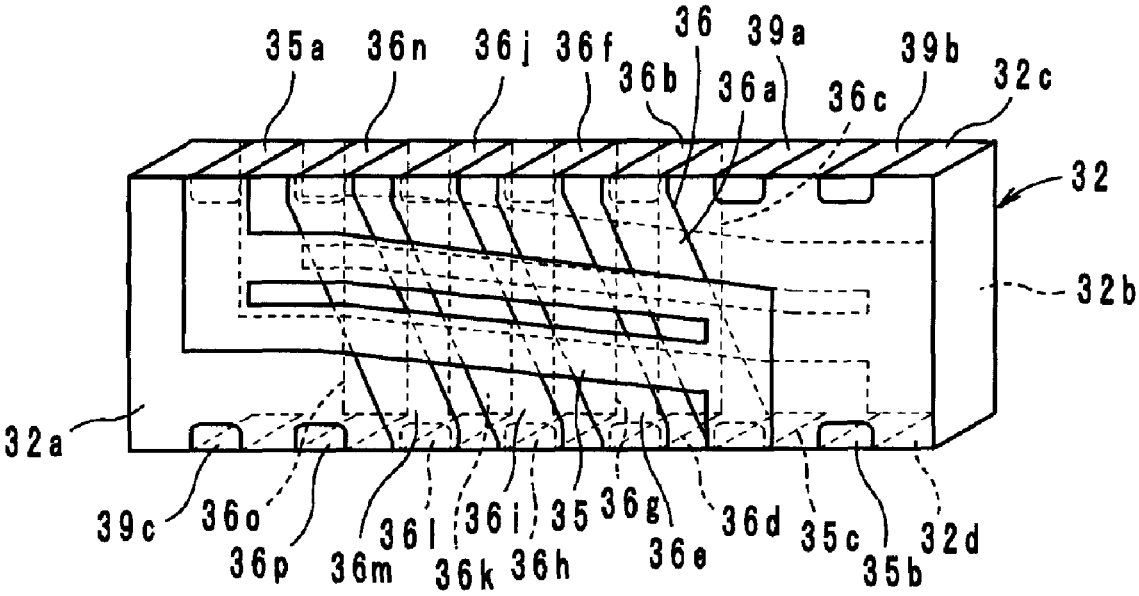
FIG. 2 is a perspective view of a ferrite including center electrodes.

As illustrated in FIG. 2, the ferrite 32 is provided with a first center electrode 35 and a second center electrode 36 that are electrically insulated from each other on first and second principal surfaces 32*a* and 32*b* of the front and rear surfaces. Here, the ferrite 32 preferably has a substantially rectangular parallelepiped shape including the first principal surface 32*a* and the second principal surface 32*b* that are facing each other and are in parallel or substantially in parallel to each other.

Figure 4:
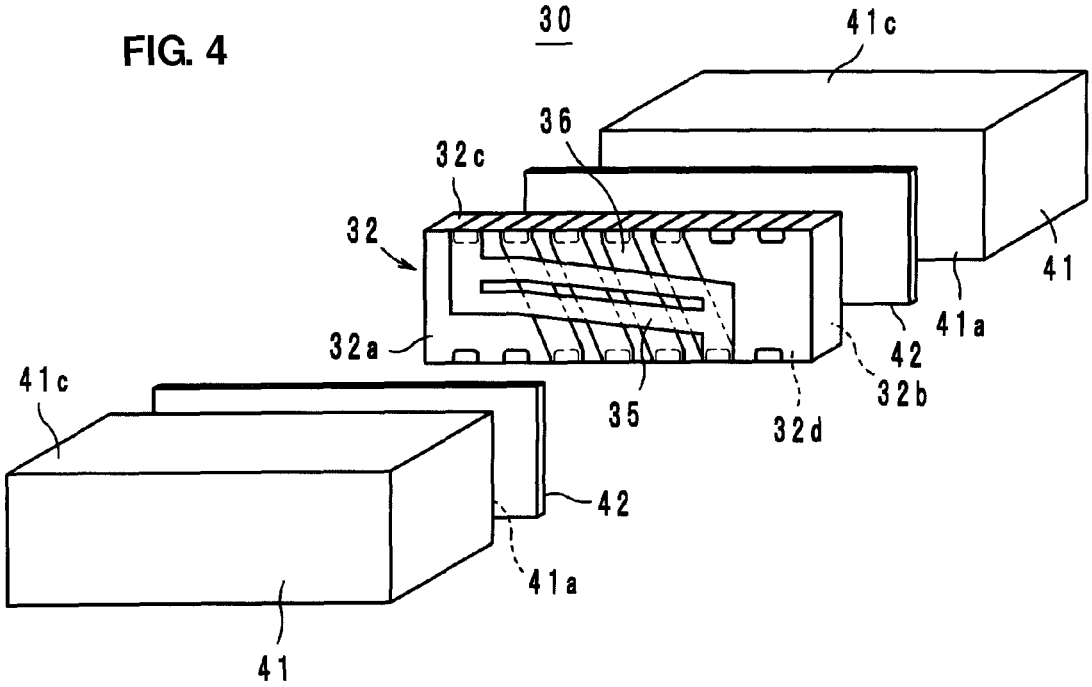
FIG. 4 is an exploded perspective view of a ferrite-magnet assembly.

The permanent magnets 41 are adhered to the ferrite 32 preferably through an epoxy adhesive 42 (FIG. 4), for example, so as to face the principal surfaces 32*a* and 32*b* so that a DC magnetic field is applied to the principal surfaces 32*a* and 32*b* in a substantially perpendicular direction to thereby define the ferrite-magnet assembly 30. The principal surfaces 41*a* of the permanent magnets 41 preferably have the same or substantially the same dimensions as the principal surfaces 32*a* and 32*b* of the ferrite 32. The principal surfaces 32*a* and 41*a* and the principal surface 32*b* and 41*a* arranged to face each other so that the outer shapes thereof line up with each other.

The first center electrode 35 is preferably made of a conductive film. More specifically, as illustrated in FIG. 2, the first center electrode 35 extends upward from a lower right section of the first principal surface 32*a* of the ferrite 32 and bifurcates into two segments. The two segments extend in an upward left direction at a relatively small angle with respect to the longitudinal direction. The first center electrode 35 then extends upward to an upper left section and turns toward the second principal surface 32*b* through an intermediate electrode 35*a* on an upper surface 32*c*. On the second principal surface 32*b*, the first center electrode 35 bifurcates into two segments so as to overlap with that on the first principal surface 32*a* in the perspective view. One end of the first center electrode 35 is connected to a connector electrode 35*b* provided on the lower surface 32*d*. The other end of the first center electrode 35 is connected to a connector electrode 35*c* provided on the lower surface 32*d*. The first center electrode 35 is thus wound around the ferrite 32 by one turn. The first center electrode 35 and the second center electrode 36, which will be described below, have an insulating film provided therebetween, such that these electrodes intersect each other while being insulated from each another.

The second center electrode 36 is preferably made of a conductive film. The second center electrode 36 includes a half-turn segment 36*a* that extends in the upward left direction from a lower right section of the first principal surface 32*a* at a relatively large angle with respect to the longitudinal direction and intersects the first center electrode 35. The half-turn segment 36*a* turns towards the second principal surface 32*b* through an intermediate electrode 36*b* on the upper surface 32*c*. On the second principal surface 32*b*, a 1st-turn segment 36*c* intersects the first center electrode 35 in a substantially perpendicular manner. A lower end portion of the 1st-turn segment 36*c* turns towards the first principal surface 32*a* through an intermediate electrode 36*d* on the lower surface 32*d*. On the first principal surface 32*a*, a 1.5-turn segment 36*e* extends parallel to the half-turn segment 36*a* and intersects the first center electrode 35. The 1.5-turn segment 36*e* turns toward the second principal surface 32*b* through an intermediate electrode 36*f* on the upper surface 32*c*. In a similar manner, a 2nd-turn segment 36*g*, an intermediate electrode 36*h*, a 2.5th-turn segment 36*i*, an intermediate electrode 36*j*, a 3rd-turn segment 36*k*, an intermediate electrode 36*l*, a 3.5th-turn segment 36*m*, an intermediate electrode 36*n*, and a 4th-turn segment 36*o* are provided on the corresponding surfaces of the ferrite 32. Both ends of the second center electrode 36 are respectively connected to connector electrodes 35*c* and 36*p* provided on the lower surface 32*d* of the ferrite 32. The connector electrode 35*c* is commonly used as a connector electrode for the ends of the first center electrode 35 and the second center electrode 36.

More specifically, the second center electrode 36 preferably is helically wound around the ferrite 32 by four turns, for example.

Here, the number of turns is calculated on the basis of the fact that one crossing of the center electrode 36 across the first principal surface 32*a* or the second principal surface 32*b* equals a 0.5 turn. The intersection angle between the center electrodes 35 and 36 is set as required so as to adjust the input impedance and the insertion loss.

Figure 3:
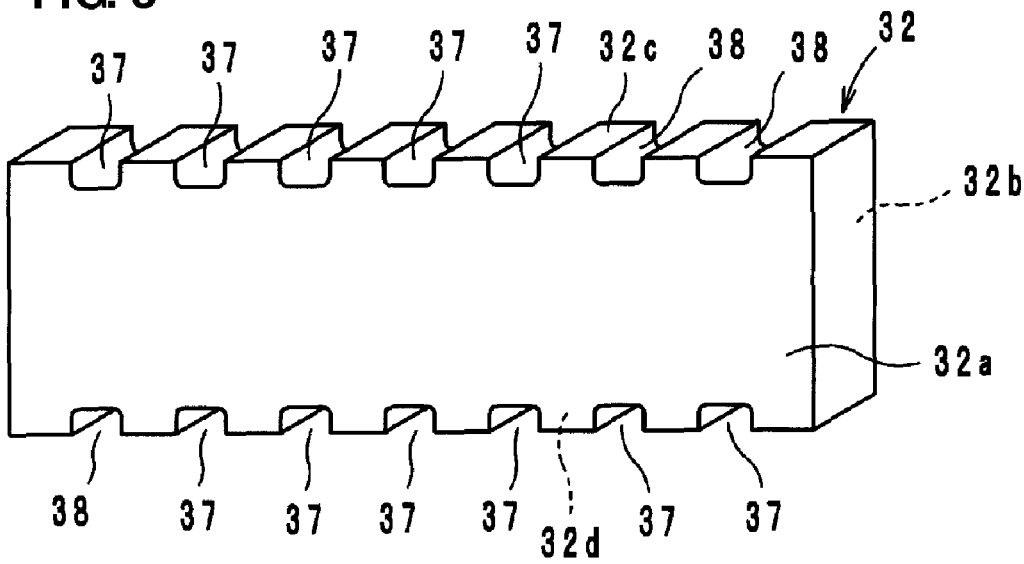
FIG. 3 is a perspective view of the ferrite.

The connector electrodes 35*b*, 35*c*, and 36*p* and the intermediate electrodes 35*a*, 36*b*, 36*d*, 36*f*, 36*h*, 36*j*, 36*l*, and 36*n* are provided by applying or embedding electrode conductors, such as silver, silver alloy, copper, and copper alloy, into corresponding recesses 37 (FIG. 3) provided in the upper and lower surfaces 32*c* and 32*d* of the ferrite 32. In addition, the upper and lower surfaces 32*c* and 32*d* have dummy recesses 38 arranged in parallel or substantially in parallel to the electrodes, and are also provided with dummy electrodes 39*a*, 39*b*, and 39*c*. These electrodes are provided by preliminarily providing through holes in a mother ferrite substrate, embedding electrode conductors into these through holes, and then cutting the substrate along where the through holes are to be cut. Various electrodes may be provided in the recesses 37 and 38 as conductor films.

As the ferrite 32, a YIG ferrite or the like may preferably be used. The first and second center electrodes 35 and 36 and the other various electrodes are provided as a thick film or a thin film composed of silver or a silver alloy by, for example, printing, transferring, or photolithography.

The insulating film between the center electrodes 35 and 36 may be formed of a thick glass or alumina dielectric film or polyimide resin film. These insulating films can also be provided by, for example, printing, transferring, or photolithography.

The ferrite 32 including the insulating film and various electrodes can be collectively baked using a magnetic material. In such a case, Pd or Pd/Ag that are tolerant of baking at high temperatures is preferably used as the various electrodes.

For the permanent magnets 41, strontium, barium, or lanthanum-cobalt ferrite magnets preferably are generally used. A one-part thermosetting epoxy adhesive is preferably used as the adhesive 42 that adheres the permanent magnets 41 and the ferrite 32.

The circuit board 20 preferably is a sintered multilayer substrate including electrodes provided on a plurality of dielectric sheets. The circuit board 20 includes matching capacitors C2, Cs1, Cs2, Cp1, and Cp2 and a terminal resistance R as illustrated in the equivalent circuits of FIGS. 6 and 7 and the matching capacitor C1 is externally mounted on the circuit board 20. The circuit board 20 also includes terminal electrodes 25*a* to 25*e* on the upper surface thereof and external-connection terminal electrodes 26, 27, and 28 on the lower surface thereof. The description of the multilayer structure in the circuit board 20 is omitted.

The ferrite-magnet assembly 30 is mounted on the circuit board 20. Various electrodes at the lower surface 32*d* of the ferrite 32 are unified with the terminal electrodes 25*a*, 25*b*, and 25*c* on the circuit board 20 by reflow soldering or the like and the lower surfaces of the permanent magnets 41 are unified with the circuit board 20 with an adhesive.

The planar yoke 10 has an electromagnetic shielding function. The yoke 10 is adhered to the upper surface of the upper surface of the ferrite-magnet assembly 30 through the adhesive layer 15. Here, the upper surface to which the planar yoke 10 is adhered refers to a plane formed of the upper surfaces 32*c* of the ferrite 32 and the upper surfaces 41*c* (FIG. 4) of the permanent magnets 41 in such a manner as to have the same height.

The planar yoke 10 has functions of suppressing magnetic leakage and high-frequency electromagnetic field leakage from the ferrite-magnet assembly 30, of suppressing magnetic influences from the external environment, and of providing a portion to be taken up by a vacuum nozzle when this isolator is to be mounted on a substrate, not shown, using a chip mounter. The planar yoke 10 does not have to be grounded and may be grounded by soldering or by using a conductive adhesive. When grounded, the yoke 10 improves the effect of the high-frequency shielding.

The planar yoke 10 is preferably made of a nickel plate plated with Ag, for example. The material of the yoke 10 is not limited to nickel, and a soft iron steel sheet, a silicon steel plate, or the like may be used. The plating may be performed with Cu or the like.

As the adhesive layer 15 that fixes the planar yoke 10 to the upper surface of the ferrite-magnet assembly 30, an adhesive having excellent heat resistance, operation properties, and mechanical strength may be selected for use as required. Phenol and amine adhesives can be preferably used. Thermosetting epoxy adhesives or the like may be used.

The planar yoke 10 is provided on the ferrite-magnet assembly 30 mounted on the circuit board 20. In this case, the yokes 10 that are cut into a given size may be individually provided or an assembled yoke in which a plurality of yokes 10 are unified may be provided while separating the assembled yokes into individual pieces. Alternatively, a process may be used which includes providing the assembled yoke 10 on the ferrite-magnet assembly 30 mounted on the circuit board 20, and thereafter separating the resultant into individual bodies by using a dicer or the like. According to such a multi-forming process, the outer shape of the circuit board 20 and the outer shape of the yoke 10 become equal.

Figure 5:
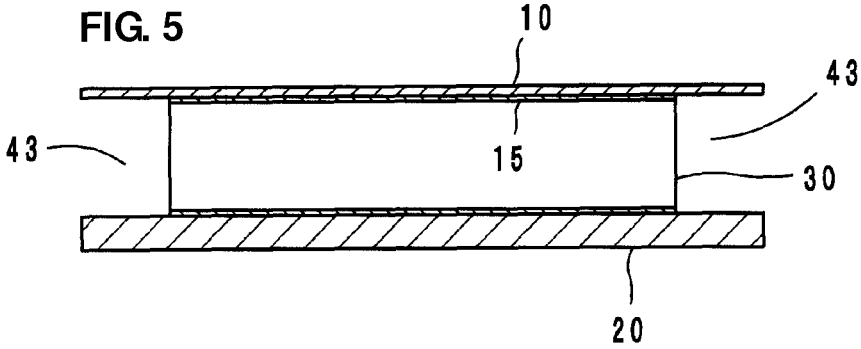
FIG. 5 is a cross sectional view of an assembled circuit board, ferrite-magnet assembly, and yoke.

FIG. 5 illustrates that the ferrite-magnet assembly 30 is mounted on the circuit board 20 and the planar yoke 10 is adhered to the upper surface of the ferrite-magnet assembly 30. A gap 43 between the circuit board 20 and the yoke 10 is sealed with a resin material, which is not illustrated.

Figure 6:
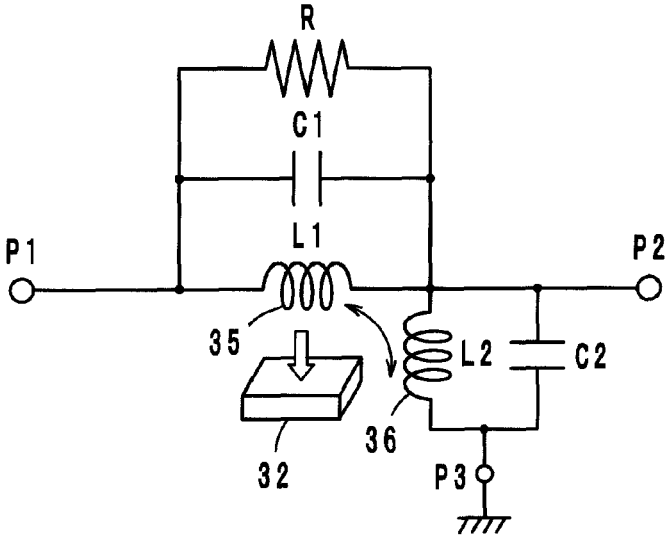
FIG. 6 is an equivalent circuit diagram of a first circuit example of a two-port isolator.
Figure 7:
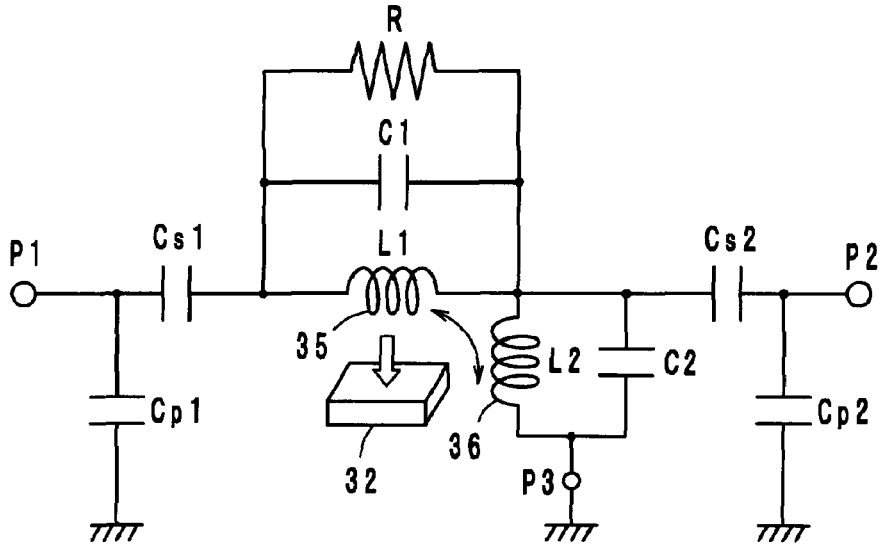
FIG. 7 is an equivalent circuit diagram of a second circuit example of a two-port isolator.

The connection relationships between these matching circuit elements and the first and second center electrodes 35 and 36 are as illustrated in FIG. 6 illustrating a first circuit example and FIG. 7 illustrating a second circuit example. Here, the connection relationships will be described based on the second circuit example illustrated in FIG. 7.

The external-connection terminal electrode 26 provided on the lower surface of the circuit board 20 functions as an input port P1, and is connected to the matching capacitor C1 and the terminal resistor R through the matching capacitor Cs1. The terminal electrode 26 is connected to one end of the first center electrode 35 through the terminal electrode 25*a* provided on the upper surface of the circuit board 20 and the connector electrode 35*b* provided on the lower surface 32*d* of the ferrite 32.

The other end of the first center electrode 35 and one end of the second center electrode 36 are connected to the terminal resistor R and the matching capacitors C1 and C2 through the connector electrode 35*c* provided on the lower surface 32*d* of the ferrite 32 and the terminal electrode 25*b* provided on the upper surface of the circuit board 20, and are also connected to the external-connection terminal electrode 27 provided on the lower surface of the circuit board 20 through the capacitor Cs2. The terminal electrode 27 functions as an output port P2. The capacitor C1 is connected to the terminal electrodes 25*d* and 25*e* provided on the upper surface of the circuit board 20.

The other end of the second center electrode 36 is connected to the capacitor C2 and the external-connection terminal electrode 28 provided on the lower surface of the circuit board 20 through the connector electrode 36*p* provided on the lower surface 32*d* of the ferrite 32 and the terminal electrode 25*c* provided on the upper surface of the circuit board 20. The electrode 28 functions as a ground port P3.

To a connection point between the input port P1 and the capacitor Cs1, a grounded capacitor Cp1 for impedance adjustment is connected. Similarly, to a connection point between the output port P2 and the capacitor Cs2, a grounded capacitor cp2 for impedance adjustment is connected.

The first circuit example illustrated in FIG. 6 is a basic type in which the devices (capacitors Cs1, Cs2, Cp1, and Cp2) in the second circuit example illustrated in FIG. 7 are partially omitted.

In the two-port isolator having the structure described above, since one end of the first center electrode 35 is connected to the input port P1, the other end of the first center electrode 35 is connected to the output port P2, one end of the second center electrode 36 is connected to the output port P2, and the other end of the second center electrode 36 is connected to the ground port P3, a two-port lumped-parameter isolator having a small insertion loss can be obtained. In addition, during operation of the isolator, a large amount of high-frequency current is supplied to the second center electrode 36 whereas a negligible amount of high frequency current is supplied to the first center electrode 35. Therefore, a direction of a high-frequency field generated using the first center electrode 35 and the second center electrode 36 depends on an arrangement of the second center electrode 36. Measures to reduce the insertion loss are readily performed when the direction of the high-frequency field is determined.

The planar yoke 10 is preferably located right above the ferrite-magnet assembly 30 through the adhesive layer 15. Therefore, a conventional annular or box-shaped yoke formed of soft iron is unnecessary, and the planar yoke IC is easy to produce or handle, whereby the cost can be reduced as a whole. Since the yoke 10 is not mechanically bonded to the circuit board 20, the circuit board 20 is free from damages due to heat stress, and thus the reliability improves.

The ferrite-magnet assembly 30 is mechanically stable because the ferrite 32 and a pair of permanent magnets 41 are unified with the adhesive 42, and thus serves as a strong isolator that is not deformed and damaged by vibration or an impact.

In a preferred embodiment of the present invention, to the adhered surface (rear surface) of the planar yoke 10 is provided with an uneven portion that increases the adhesive strength and facilitates the flow of a high-frequency field generated from the second center electrode 36 during operation into the outer layer of the planar yoke 10 or the adhesive layer 15.

Figure 8A:
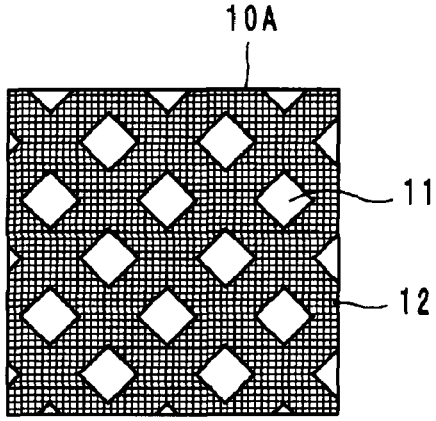
FIGS. 8A and 8B illustrate a planar yoke as a first example, in which FIGS. 8A and 8B each are rear views.

FIG. 8A illustrates the adhered surface of the planar yoke 10A as the first example, in which island-shaped protrusions 11 having a minute square shape are provided in a lattice manner while being inclined at an angle of approximately 45° with respect to the four sides of a yoke 10A. In FIG. 8A, a recess 12 is meshed. Such protrusions 11 and recess 12 can be easily provided by etching.

Figure 8B:
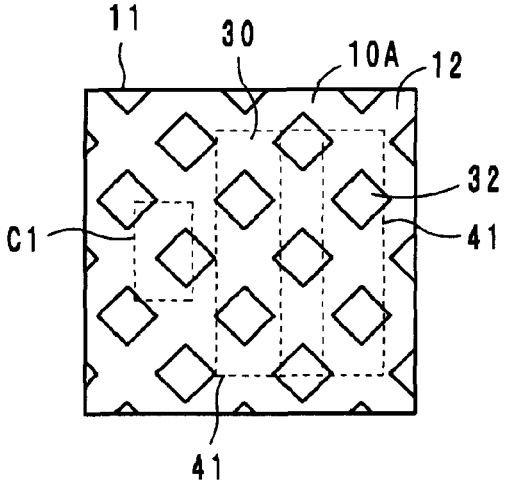
Figure 9:
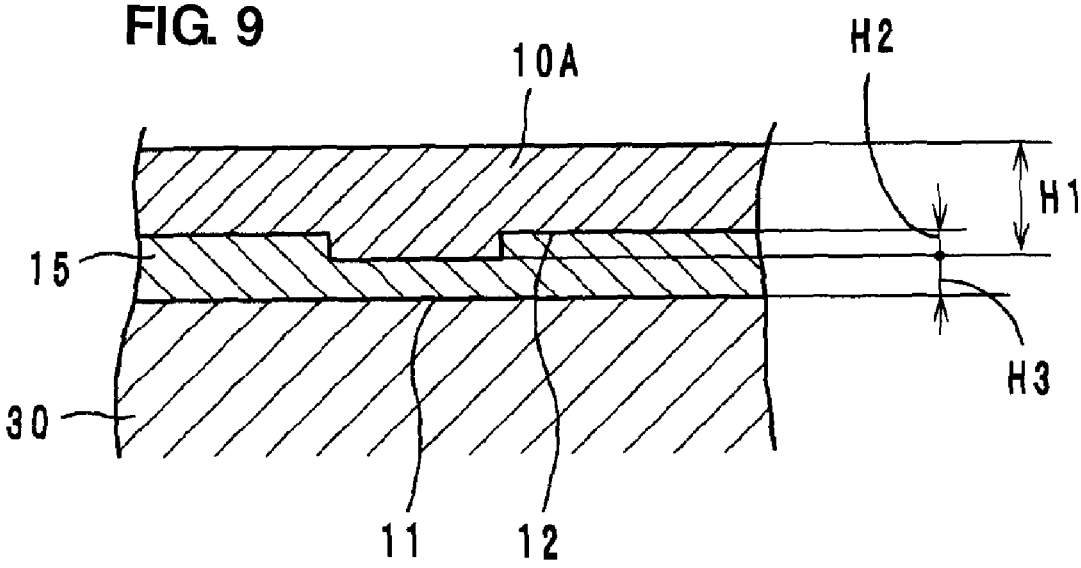
FIG. 9 is an expanded cross sectional view of the ferrite-magnet assembly, the yoke, and an adhesive layer.

FIG. 8B illustrates a positional relationship between the protrusions 11 and the recess 12 of the yoke 10A and the ferrite-magnet assembly 30 and between the protrusions 11 and the recess 12 of the yoke 10A and the capacitor C1. FIG. 9 enlargedly illustrates the adhered portion. An example of dimensions will be described. The thickness H1 of the yoke 10A is about 100 μm, the depth H2 of the recess 12 is about 30 μm, and the thickness H3 of the adhesive layer 15 is about 40 μm, for example. The protrusion 11 has approximate dimensions of 200 μm×200 μm and the interval between the protrusions 11 is about 200 μm, for example. Thus, by providing the protrusions 11 and the recess 12 in a lattice manner to the adhered surface of the planar yoke 10A, the adhered surface fits to the adhesive layer 15 to thereby increase the adhesive strength. Moreover, the air between the adhered surface and the upper surface of the ferrite-magnet assembly 30 is released well when adhered. Therefore, position shift or peeling at the time of cutting the yoke 10A from a matrix is overcome. The adhesive strength was analyzed for a mere planar yoke and the yoke 10A as the first example. In the case of a phenol adhesive, the adhesive strength of the mere planar yoke was about 6.8 N, and, in contrast, the adhesive strength of the yoke 10A increased to about 11.0 N. Moreover, in the case of an amine adhesive, the adhesive strength of the mere planar yoke was about 3.7 N, and, in contrast, the adhesive strength of the yoke 10A increased to about 7.1 N.

When the yoke 10A is cut from a matrix by a dicer, the cutting tooth of the dicer contacts the protrusions 11 at an angle of approximately 45°. Thus, position shift or peeling is hard to occur in the yoke 10A. When the cutting tooth of the dicer temporarily contacts the protrusions 11 at a minute angle, a force in a horizontal direction greatly acts on the protrusions 11, whereby the yoke 10A is likely to shift during cutting.

Figure 10A:
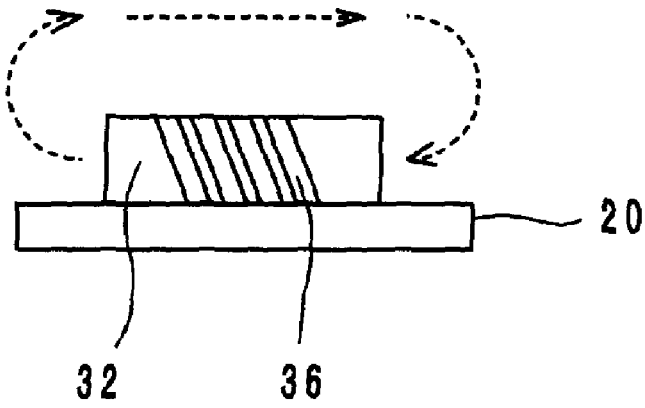
FIGS. 10A and 10B are views illustrating the flow of a high-frequency field.
Figure 10B:
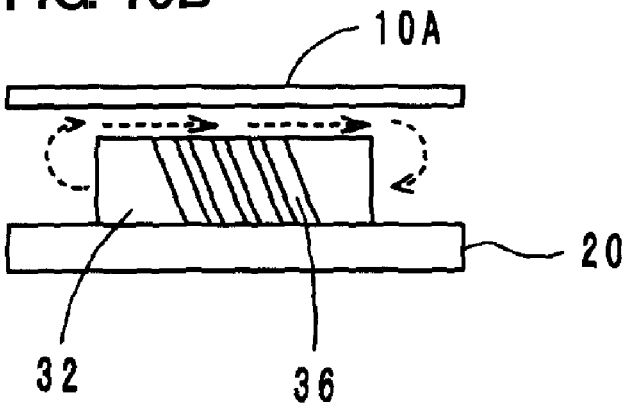

The reason why the properties during operation improve by providing the protrusions 11 and the recesses 12 is as follows. During operation, when the yoke 10A is not present, a high-frequency field generated from the second center electrode 36 tends to extend in a wide range as illustrated by the dotted line in FIG. 10A. As illustrated in FIG. 10B, when the yoke 10A is adjacent to the upper surface of the ferrite 32, the high-frequency field tends to pass through a gap between the upper surface of the ferrite 32 and the yoke 10A. In this case, when the rear surface of the yoke 10A is adhered to the upper surface of the ferrite 32, the flow of the high-frequency field is disturbed. By providing the protrusions at the rear surface (adhered surface) of the yoke 10A, a passage (minute gap) for the high-frequency field can be secured. Thus, the high-frequency field flows into the outer layer of the yoke 10A or the adhesive layer 15, which improves performance characteristics in a high frequency band (particularly 800 MHz to 5 GHz).

Figure 11A:
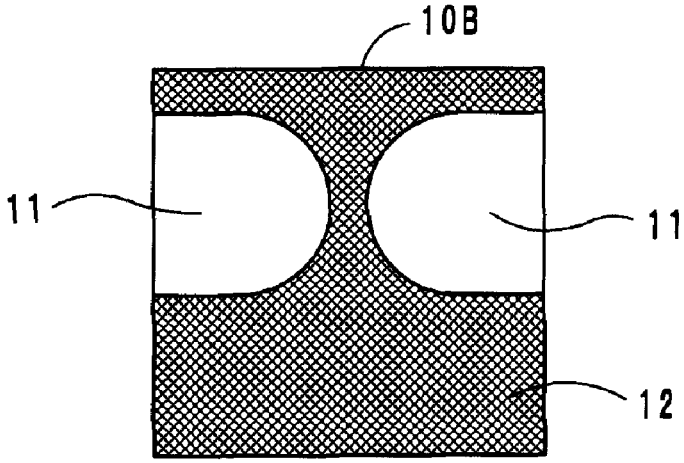
FIGS. 11A and 11B illustrate a planar yoke as a second example, in which FIGS. 8A and 8B each are rear views.
Figure 11B:
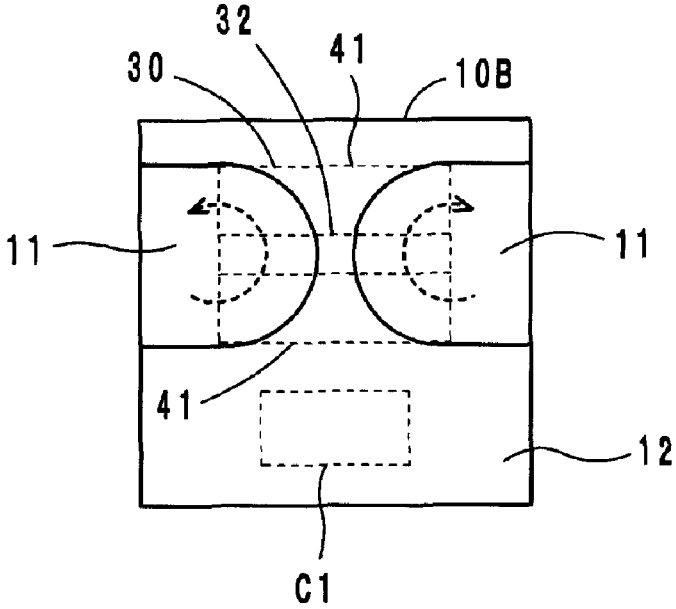

FIG. 11A illustrates the adhered surface of a planar yoke 10B as a second example, in which, circular protrusions 11 are provided at portions corresponding to both ends of the ferrite 32 (FIG. 11B). In FIG. 11A, the recess 12 is meshed. Such protrusions 11 and recess 12 can be easily provided by etching.

FIG. 11B illustrates a physical relationship between the protrusions 11 of the yoke 10B and the ferrite-magnet assembly 30. The thickness of the yoke 10B, the depth of the recess 12, the thickness of the adhesive layer 15, etc., are as described in the description of the yoke 10A above. Thus, by providing the protrusions 11 and recess 12 to the adhered surface of the planar yoke 10B, the adhered surface fits to the adhesive layer 15 to thereby increase the adhesive strength. Therefore, position shift or peeling at the time of cutting the yoke 10B from a matrix is overcome.

In the yoke 10B, the reason why the properties during operation improve by providing the protrusions is as follows. When the high-frequency field generated from the second center electrode 36 during operation tends to pass the yoke 10B, an eddy current arises in the yoke 10B by the magnetic field that tends to pass, which hinders the passage of the high-frequency field. By providing the protrusions 11 to a portion where the high-frequency field passes, (portion where the high-frequency field concentrates, specifically a portion near both ends of the ferrite 32 in the long side direction), an eddy current (dotted-line arrow of FIG. 11B) that hinders the passage of the high-frequency field is likely to occur, and thus the high-frequency field passes well through the outer layer of the yoke 10B or the adhesive layer 15, whereby performance characteristics in a high frequency band (particularly 800 MHz to 5 GHz) increase.

Figure 12:
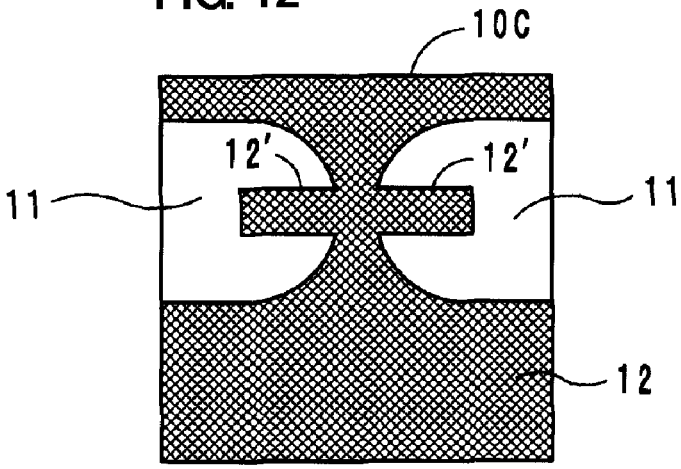
FIG. 12 is a rear view of a planar yoke as a third example.

FIG. 12 illustrates the adhered surface of a planar yoke 10C as a third example, in which protrusions 11 basically similar to those of the yoke 10B as the second example are provided and a recess 12' is provided to the protrusions 11 as the passage of the high-frequency field.

The non-reciprocal circuit device according to the invention is not limited to the examples of preferred embodiments described above, and can be variously changed within the scope of the present invention.

In particular, the uneven portion provided to the adhered surface of the planar yoke can have various shapes, and the protrusions in a lattice manner may be a circular, triangular, oval shape, etc., in addition to the square shape as illustrated in FIGS. 8A and 8B.

As described above, preferred embodiments of the present invention are useful for a non-reciprocal circuit device, and are excellent particularly in that a yoke is small-sized, has a simple structure, has sufficient adhesive strength, and can achieve favorable performance characteristics.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit device, comprising:

permanent magnets;

a ferrite to which a DC magnetic field is applied by the permanent magnets;

a first center electrode and a second center electrode including a conductor film and being arranged on the ferrite so as to intersect each other while being electrically insulated from each other; and a planar yoke; wherein the ferrite and the permanent magnets define a ferrite-magnet assembly that is sandwiched by the permanent magnets from both sides in parallel or substantially in parallel with a surface on which the first and second center electrodes are provided;

the planar yoke is adhered to an upper surface of the ferrite-magnet assembly through an adhesive layer; and a surface of the planar yoke that is adhered to the upper surface of the ferrite-magnet assembly is provided with an uneven portion that increases adhesive strength and facilitates flow of a high-frequency field generated from the first and second center electrodes.

2. The non-reciprocal circuit device according to claim 1, wherein the planar yoke has a square or substantially square shape including four sides, the uneven portion includes an island-shaped protrusion, and each side of the protrusion inclines at an angle of approximately 45° with respect to the four sides of the yoke.

3. The non-reciprocal circuit device according to claim 1, wherein the uneven portion includes a protrusion that is arranged to facilitate development of an electrical current in the yoke, the electrical current preventing a high-frequency field generated from the second center electrode from passing through the yoke.

4. The non-reciprocal circuit device according to claim 1, wherein the uneven portion includes an etched portion.

5. The non-reciprocal circuit device according to claim 1, wherein a first end of the first center electrode is electrically connected to an input port, a second end of the first center electrode is electrically connected to an output port, a first end of the second center electrode is electrically connected to an output port, a second end of the second center electrode is electrically connected to a ground port, a first matching capacitor is electrically connected between the input port and the output port, a second matching capacitance is electrically connected between the output port and the ground port, and a resistance is electrically connected between the input port and the output port.

6. The non-reciprocal circuit device according to claim 1, further comprising a circuit board including a terminal electrode provided on a front surface, wherein the ferrite-magnet assembly is arranged on the circuit board in such a manner that the surface on which the first and second center electrodes are located is perpendicular or substantially perpendicular to the front surface of the circuit board, and the planar yoke is located on the upper surface of the ferrite-magnet assembly through an adhesive layer.

* * * * *